US006029760A

United States Patent [19]

Hall

[11] Patent Number: 6,029,760

[45] Date of Patent: Feb. 29, 2000

[54] SUPERHARD CUTTING ELEMENT UTILIZING TOUGH REINFORCEMENT POSTS

[76] Inventor: David R. Hall, 2185 S. Larsen Pkwy., Provo, Utah 84606

[21] Appl. No.: 09/040,658

[22] Filed: Mar. 17, 1998

[51] Int. Cl.[7] ..... E21B 10/46

[52] U.S. Cl. ..... 175/432; 175/434; 51/295

[58] Field of Search ..... 175/431, 432, 175/434, 428; 51/295

[56] References Cited

U.S. PATENT DOCUMENTS 5,355,969 10/1994 Hardy et al. ..... 175/432
5,564,511 10/1996 Frushour ..... 175/431
5,622,233 4/1997 Griffin ..... 175/432
5,662,720 9/1997 O'Tighearnaigh ..... 51/295
5,862,873 1/1999 Matthias et al. ..... 175/432
5,875,862 3/1999 Jurewicz et al. ..... 175/432

*Primary Examiner*—Frank Tsay

[57] ABSTRACT

This invention relates to superhard cutting elements. Specifically, this invention relates to polycrystalline diamond and cubic boron nitride cutting elements produced by means of high pressure and high temperature. The cutting element of this invention features cylindrical reinforcement posts to toughen the cutting surface in the same fashion that rebar strengthens concrete. This invention also discloses an economical means of producing the substrate of the present invention.

8 Claims, 3 Drawing Sheets

SUPERHARD CUTTING ELEMENT UTILIZING TOUGH REINFORCEMENT POSTS

CROSS-REFERENCES TO RELATED APPLICATIONS NONE

BACKGROUND OF THE INVENTION

This invention relates to superhard cutting elements useful in rock drilling and machining wear resistant materials. Specifically, this invention relates polycrystaline diamond and cubic boron nitride cutting elements produced by means of high pressure and high temperature. Although these two super materials have divergent properties, it is not uncommon in the literature to speak in terms of one or both when addressing common issues. Since the issues raised in this application apply generally to both materials, the application will speak in terms of a superhard material. Those skilled in the art will readily understand the utility of this invention as it applies to both supermaterials.

Superhard cutting elements are now so widely accepted in the drilling and tooling industries that they have become the standard and preferred tool for difficult applications. But these tools are not without limitations. Superhard materials have high hardness and abrasion resistance, but generally speaking, standing alone, they lack the toughness required by most difficult drilling and cutting jobs. By mounting the superhard material on a tough substrate, such as tungsten carbide, a certain amount of synergism is achieved; the superhard cutting element acquires the toughness of the substrate to go along with the hardness and abrasion resistance of the superhard material, itself.

In the art, varied attempts have been made to improve the utility of superhard cutting elements. These efforts have largely centered on improving the bond between the substrate and the superhard material. An example of this issue is addressed but not fully taught in U.S. Pat. No. 5,460,233. The problem ostensibly addressed in that patent was to provide a means of protecting the cutting table of a rock drilling element from damage as the cutting element first contacted formation being drilled. That is to say, as the bit was lowered into the hole and impacted the formation to be drilled, there was a tendency for the superhard surface of the cutting elements to fracture and delaminate. The applicants discovered that by contouring the substrate away from the superhard cutting surface, they were able to sufficiently protect the superhard materials long enough for it to wear into a safe mode. The published data showed that the substrate thus configured could withstand more than double the WOB of conventional cutting elements. What the disclosure failed to find was a means of actually imparting the toughness of the substrate into the superhard cutting table itself.

Therefore, it would be useful to provide a means for reinforcing the superhard cutting surface and give it the toughness inherent in the tungsten carbide substrate, while at the same time providing an inherently tougher superhard cutting surface.

SUMMARY OF THE INVENTION

It is an object of this invention to impart the toughness of the substrate into the superhard surface of the cutting element. This is achieved by providing reinforcing posts that project from the substrate into the superhard surface, lending it the toughness of the substrate, much like rebar strengthens concrete.

It is another object of this invention to provide a simpler and more economical means of producing the posts.

It is another object of this invention to provide a substrate configuration that reduces stress concentrations, and at the same time facilitates mounting the superhard material on the substrate prior to processing at high pressure and high temperature.

DETAILED DESCRIPTION

Although not as hard and abrasion resistant, the tungsten carbide substrate is actually tougher than the superhard cutting surface it supports. The diverse properties between the substrate and the superhard cutting surface are well documented in the art, and many attempts have been made to lessen the effects of those differences when the two are bonded together. These effects and differences are well taught in U.S. Pat. Nos. 5,662,720 and 5,564,511 and are incorporated herein by this reference. While the present invention acknowledges the teachings of the prior art, it departs from the commonly held conclusion that internal stresses may only be diffused by a substrate that "does not ejaculate in any cross-section to cause abrupt angular changes." The present invention discloses an equally effective, less complex, and more economical solution for reinforcing the superhard cutting surface.

The first aspect of the present invention is to impart to the superhard cutting surface the toughness of the substrate. This is achieved by providing tungsten carbide posts that project into the cutting surface from the substrate. These posts impart toughness to the superhard surface much like rebar adds toughness to concrete. Although the configuration of the reinforcement posts of the present invention departs from the teachings of the cited patents, the applicant has surprisingly discovered that the impact toughness of a cutting element having the posts doubled over prior art elements having a planar interface. Also, the elements of the present invention did not manifest the spalling and delamination of the superhard cutting surface as predicted in the prior art. It appears to the applicant that the posts of the present invention lend sufficient toughness to the superhard material to overcome whatever stresses build up due to the different properties in the superhard material and the substrate.

Figure 1:
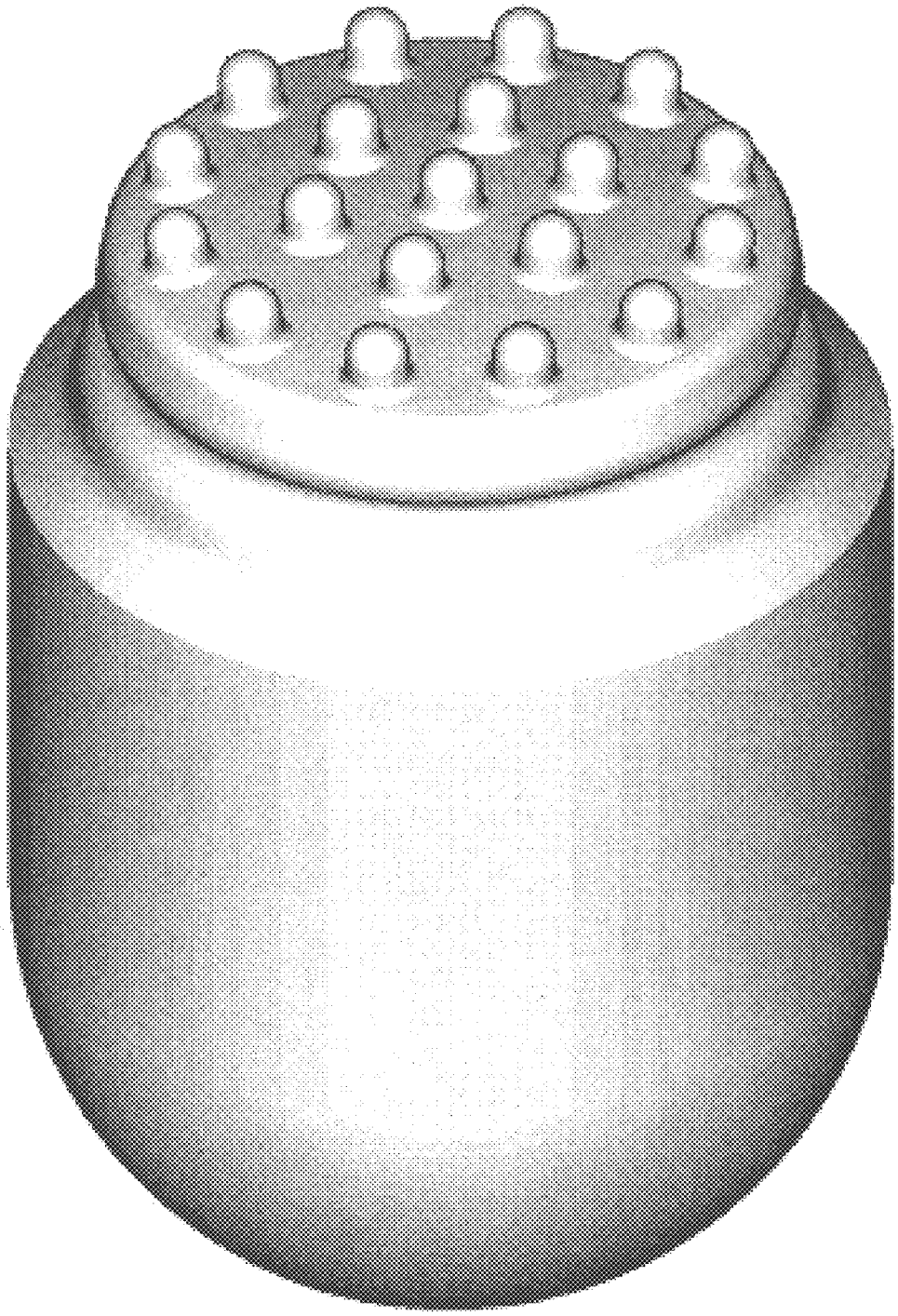
FIG. 1 is a perspective drawing of a substrate of the present invention depicting the posts.
Figure 2:
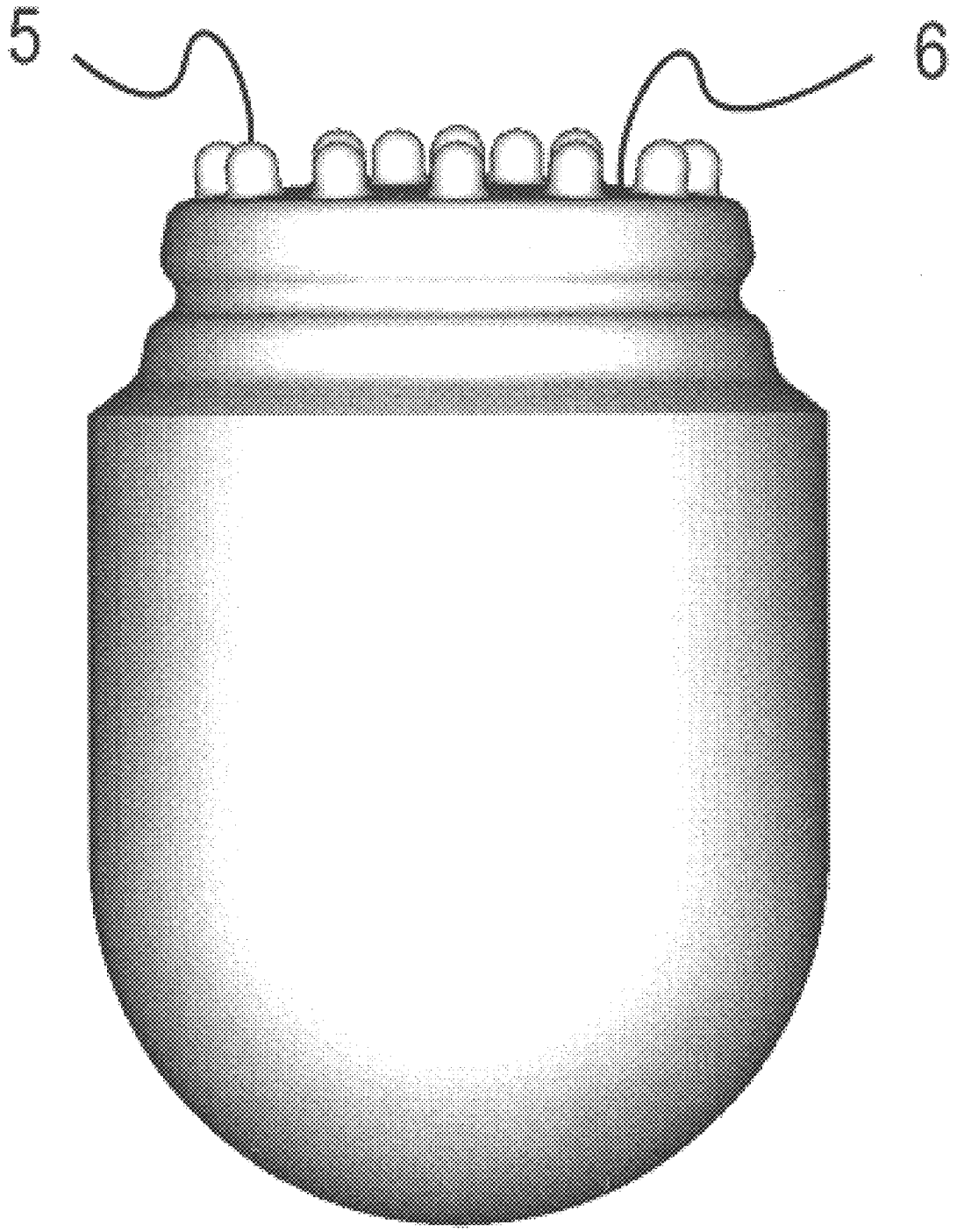
FIG. 2 is a frontal view of the substrate of the present invention depicting the convex contour of the bonding surface as well as the posts.

FIG. 1 is a perspective illustration of a preferred embodiment of a substrate of this invention. The posts are arrayed across the surface of the substrate in either a regular or random pattern. They should be tall enough to impart strength to the superhard material, but not so tall as to protrude above the cutting surface. In thin layer applications, the height of these posts could be a little as 0.1 mm. In thick layer applications of over 1.5 mm, the height should be at least 0.5 mm. It is critical to this application that the posts extend at least one third of the way into the superhard material of the cutting surface. For example, in the tests conducted by the applicant, the posts projected 1 mm into a superhard cutting surface approximately 2.5 mm FIG. 2 is a frontal view of the substrate of the present invention. The nominal surface (6) of the substrate is depicted as being convex, and the posts (5) are depicted at right angels to the convex surface. The convex surface acts to increase the surface area of attachment as well as to evenly redistribute interfacial stresses known to exist between the substrate and the superhard material. The heights of the posts may vary according to the application of the cutting element. For example, the peripheral posts could be taller while the interior posts may be shorter. The posts may be removed from the outer periphery or they may actually be sectioned by the periphery so that their pattern is visible on the outside of the cutting element.

Figure 3:
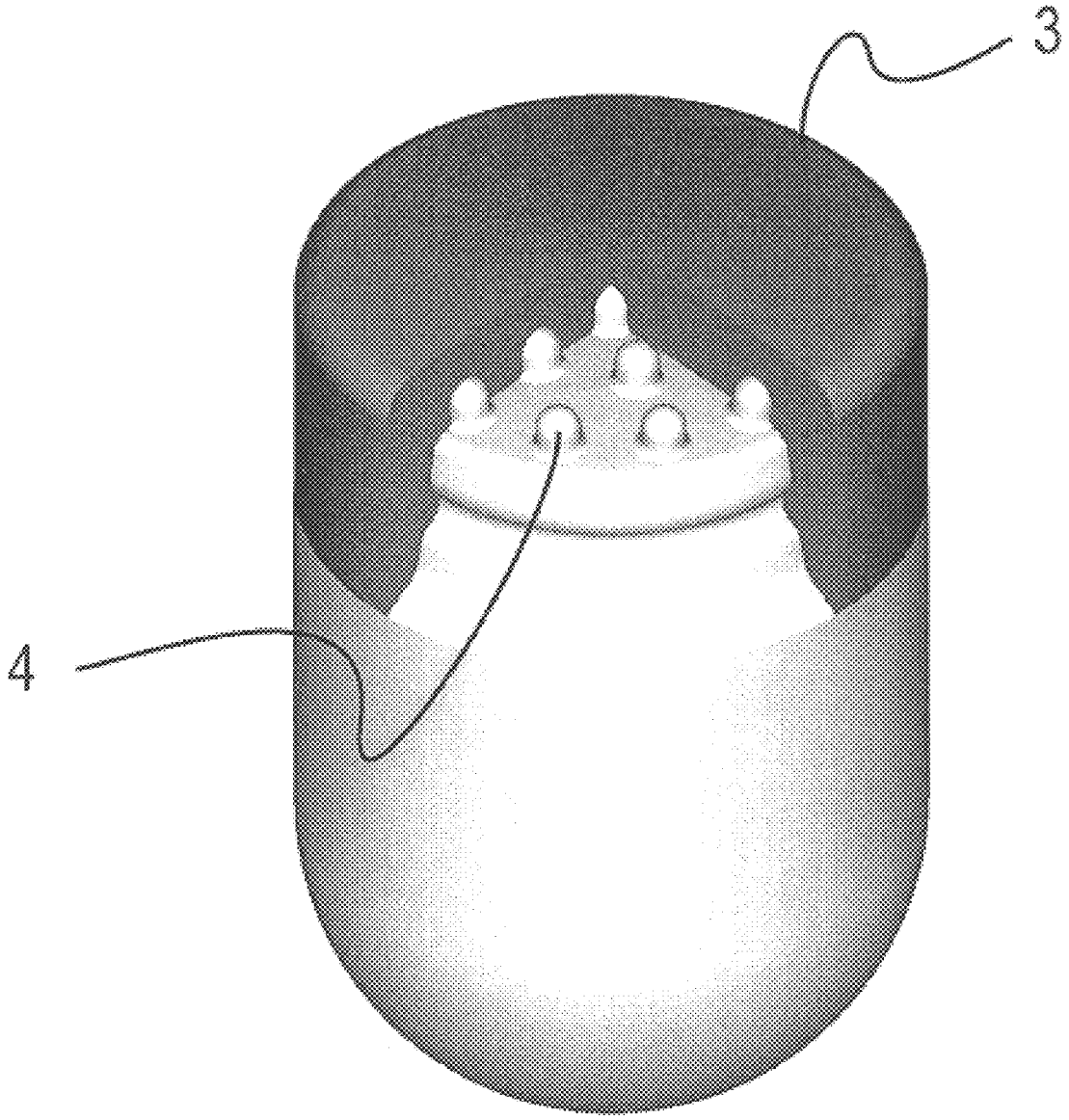
FIG. 3 is perspective view of the cutting element of the present invention depicting a cut away view of the superhard cutting surface.

FIG. 3 is a perspective view of the cutting element of the present invention depicting a cutaway view of the superhard cutting surface (3) and the reinforcement posts (4). The posts (4) extend at least a third of the way into the superhard material Another aspect of this invention is that the substrate is less complex and more economical to manufacture. The posts of the present invention are preformed into the substrate by means of a negative impression mold. Because the posts stand apart and are essentially cylinders with rounded tops, they can be machined into the mold using conventional milling techniques. This allows for more economical production and maintenance of the molds. It also facilitates varying the post patterns depending upon the specific application of the cutting element. Whereas it may be very expensive to alter the complex patterns disclosed in the prior art, the design of the present invention can be altered inexpensively using standard milling equipment.

Another feature of the less complex pattern disclosed herein is that it also facilitates the mounting of the superhard material onto the substrate prior to processing at high pressure and high temperature. In mounting the superhard material, it is important to pre-compact the layers of superhard material in order to achieve sufficient pre-processing density and eliminate voids in the mass. The more complex the surface onto which the superhard material is mounted, the more difficult it is to sufficiently pre-compact the material. Low density and voids in the mass contribute to excessive shrinkage and low internal pressures and prevent superhard grain intergrowth, which leads to catastrophic failure of the element. The complex interfacial patterns also make it more difficult to manufacture and mount pre-formed layers of superhard material.

I claim:

1. A cutting element comprising:

(a) A cutting table comprised of a superhard material selected from the group consisting of polyctystalline diamond or cubic boron nitride;

(b) a substrate comprised of a tough material less hard than that of the cutting table;

(c) the substrate further comprising a substantially convex surface that is integrally bonded to the cutting table; and (d) the convex surface of the substrate further comprising a plurality of spaced apart rounded cylindrical posts, being preformed into the substrate by means of an economical negative impression mold, and disposed along the substantially convex surface in such a manner that they protrude into the cutting table at right angles, adding reinforcement to the superhard material.

2. The rounded cylindrical posts of claim 1(*d*) further being evenly spaced along the nominal surface of the substrate.

3. The rounded cylindrical posts of claim 1(*d*) further being uniform in height above the nominal convex surface of the substrate.

4. The rounded cylindrical posts of claim 1(*d*) further being graduated in height so that those in the center of the cutting element are shorter than those on the outside.

5. The rounded cylindrical posts of claim 1(*d*) further being shorter on the side of the cutting element in contact with the material being worked.

6. The rounded cylindrical posts of claim 1(*d*) further being located only in the center of the cutting element so as to maintain a thicker cutting table at the edges of the cutting element.

7. The rounded cylindrical posts of claim 1(*d*) further being cut by the outer perimeter of the cutting element so that a cross section of the post pattern is visible.

8. The rounded cylindrical posts of claim 1(*d*) further being sufficiently spaced apart so as to facilitate mounting of the superhard material.

* * * * *